US011447308B1

(12) United States Patent
Lin

(10) Patent No.: US 11,447,308 B1
(45) Date of Patent: Sep. 20, 2022

(54) CUP LID WITH PRESSING LINKAGE

(71) Applicant: Shenzhen Zhongmin Technology Co., Ltd., Guangdong (CN)

(72) Inventor: Yitong Lin, Guangdong (CN)

(73) Assignee: Shenzhen Zhongmin Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/525,935

(22) Filed: Nov. 14, 2021

(30) Foreign Application Priority Data

Sep. 29, 2021 (CN) ..... 202111149804.4

(51) Int. Cl.
*B65D 47/08* (2006.01)
*B65D 47/20* (2006.01)

(52) U.S. Cl.
CPC ..... *B65D 47/0857* (2013.01); *B65D 47/20* (2013.01)

(58) Field of Classification Search
CPC .... B65D 47/0857; B65D 47/20; B65D 43/02; B65D 43/18; B65D 43/20; B65D 43/26; B65D 47/32; B65D 51/18; B65D 2543/00046; A47G 19/2272
See application file for complete search history.

(56) References Cited

U.S. PATENT DOCUMENTS

| | | | | |
|---|---|---|---|---|
| 6,098,834 | A * | 8/2000 | Hatsumoto | A47G 19/2272 220/756 |
| 7,546,933 | B2 * | 6/2009 | Pinelli | B65D 51/18 220/714 |
| 8,978,923 | B2 * | 3/2015 | George | B65D 43/267 215/311 |
| 9,462,904 | B2 * | 10/2016 | Coon | A47G 19/2272 |
| 9,706,863 | B2 * | 7/2017 | Huang | A47G 19/2288 |
| 9,908,687 | B2 * | 3/2018 | Chiou | B65D 47/20 |
| 9,913,552 | B2 * | 3/2018 | Elsaden | B65D 47/249 |
| 10,259,620 | B2 * | 4/2019 | Matthis | B65D 47/0866 |
| 10,336,513 | B2 * | 7/2019 | Wodka | B65D 43/16 |
| 2014/0263476 | A1 * | 9/2014 | Blain | B65D 43/16 222/545 |

* cited by examiner

*Primary Examiner* — Donnell A Long

(57) ABSTRACT

Disclosed is a cup lid with pressing linkage, which includes a hollow cover body with a water outlet. A linkage assembly including a first linkage, a second linkage, and a third linkage that are connected in sequence is arranged in the cover body; a though-hole is provided on one side of the cover body, and a pressing handle is hinged to an outer wall of the cover body and is rotatable relative to the cover body around the hinge. One end of the pressing handle is hinged to one end of the linkage assembly through the though-hole, and the other end of the linkage assembly is connected with a sealing plug to open and seal the water outlet. The pressing handle can be operated with one hand and the sealing plug is driven via the linkage assembly to open or close the water outlet.

10 Claims, 7 Drawing Sheets

CUP LID WITH PRESSING LINKAGE

CROSS REFERENCE TO RELATED APPLICATIONS

The present application is based on Chinese patent application No. 202111149804.4 filed on Sep. 29, 2021, and claims its priority. The entire disclosure of the application is incorporated herein by reference in its entirety.

TECHNICAL FIELD

The present disclosure relates to the technical field of water containers, in particular to a cup lid with pressing linkage.

BACKGROUND

The conventional travel mugs mainly include three types. The first type has the most common cup lid design. This type of insulated cup are used directly after opening the lid, but they are easy to lose heat while drinking with the lid open, which affects the heat insulating effect. At the same time, the lid needs to be opened as a whole and cannot be operated with one hand. The second type is opened by pressing, that is, a pressing mechanism is provided at the center of the cup lid, and water can be discharged by pressing the pressing mechanism. Although this type of thermo cups is convenient to carry and can be operated with one hand, however, there are a large amount of bacteria on fingers, which may easily contaminate the water outlet of the pressing mechanism during contact, and indirectly affects the quality of drinking water, moreover, the finger may be burned when pressing. The third type has a straw design. This type of insulated cups is difficult to pour water directly along the water outlet, and the bacteria in the human mouth will easily contaminate the straw when drinking directly through the straw, and even burn user's mouth during drinking. Therefore, there is a need for a portable water container or insulated cup that may be operated with one hand, with fast transmission to open the water outlet when pressing, and at the same time avoids the water outlet being contaminated.

SUMMARY

An objective of the present disclosure is to provide a cup lid with pressing linkage, which has a compact structure that can be operated with one hand. The cup lid has a fast transmission and a low gear ratio to open a water outlet when pressing, as well as a good sealing effect, in order to avoid leakage and contamination of the water outlet.

In order to solve the above-mentioned problems, a technical proposal of the present disclosure provides:

a cup lid with pressing linkage, the cup lid including a hollow cover body with a water outlet, a linkage assembly including a first linkage, a second linkage, and a third linkage that are connected in sequence being arranged in the cover body.

A though-hole is provided on one side of the cover body, and a pressing handle is hinged with an outer wall of the cover body and is rotatable relative to the cover body around a hinge point. One end of the pressing handle passes through the though-hole and is hinged to one end of the first linkage.

A partitioning plate is provided in the cover body, with a first limiting hole provided thereon. One end of the second linkage passes through the first limiting hole and is connect to an end of the first linkage away from the pressing handle.

The first limiting hole is used for restricting the second linkage so that the second linkage moves linearly.

The other end of the second linkage is hinged with one end of the third linkage, and the other end of the third linkage is connected with a sealing plug. The third linkage is used for controlling the sealing plug to open or seal the water outlet.

Preferably, the third linkage includes a first supporting rod and a second supporting rod that are integrally connected with an angle of 60° to 150° therebetween. Limiting plates are arranged on two sides corresponding to the third linkage on an inner wall of the cover body. The first supporting rod and the second supporting rod are hinged to the limiting plates at a connection point therebetween, and ends of the first supporting rod and the second supporting rod that are away from the connection point are connected with the second linkage and the sealing plug, respectively.

Preferably, the sealing plug is located below the water outlet, and a pressing hole matching an end portion of the second supporting rod is provided on the sealing plug, and one end of the second supporting rod is disposed inside the pressing hole for pressing the sealing plug downward.

Preferably, a first reset spring is disposed between a lower end of the sealing plug and the inner wall of the cover body, and the first reset spring is used for controlling the sealing plug to move upward.

Preferably, an upper end of the sealing plug is provided with a silicone sheet matching with the water outlet.

Preferably, a second reset spring is disposed between the other end of the second linkage that is away from the first linkage and the partitioning plate.

Preferably, sliding grooves are provided along a vertical direction on two sides of the sealing plug, and sliding rails matching with the sliding grooves are provided on two sides of the inner wall of the cover body corresponding to the sealing plug, so that the sealing plug can move linearly along the sliding rails.

Preferably, a limiting slot is provided at the one end of the first linkage that is close to the second linkage, and a limiting shaft is disposed inside the limiting slot along a vertical direction. The one end of the second linkage is provided with a second limiting hole in clearance fit with the limiting shaft, and the limiting shaft converts a rotary motion of the first linkage into a linear motion of the second linkage.

Preferably, the partitioning plate separates the cover body into a first cavity and a second cavity, the water outlet is in communication with the second cavity, the second linkage is fitted to and sealed with the first limiting hole, and a bottom wall of the cover body is provided with a water inlet in communication with the second cavity.

Preferably, the cover body includes an upper casing and a lower casing that are in sealing connection while are detachable from each other. The linkage assembly is located between the upper casing and the lower casing, and the water inlet is located on the lower casing.

Preferably, a locking pin for blocking one side of the first linkage is arranged inside the first cavity, and the locking pin is provided with a knob extending out of a side wall of the cover body.

Preferably, a cap matching with the water outlet is hinged to the outer wall of the cover body, and a protection frame corresponding to a periphery of the pressing handle is provided on the side wall of the cover body.

A cup, including the above-mentioned cup lid with pressing linkage, further includes a hollow cup body, and the cup body is sealed while detachably connected with the cup lid.

The advantageous effects of the present disclosure compared with the prior art are that the cup lid with pressing linkage provided has a compact structure. The pressing handle is connected with the sealing plug through the linkage assembly, so that the pressing handle may be operated with one hand, and then control the sealing plug to open or close the water outlet through transmission via the linkage assembly. The linkage assembly provided has high transmission efficiency and a low gear ratio, for example, the sealing plug may be pressed 7 mm downward when the pressing handle is pressed 4 mm downward, which is operated easily and efficiently. The cup lid may be applied on insulated cups and water bottles, which may have a better sealing effect and, at the same time, prevent leakage and contamination of the water outlet so that may improve user experience comparing to existing products.

BRIEF DESCRIPTION OF THE DRAWINGS

In order to more clearly illustrate the technical proposals of the embodiments of the present disclosure, the drawings used in the description of the embodiments will be briefly described below. Obviously, the drawings in the following description are some embodiments of the present disclosure, one of ordinary skill in the art, without any creative effort, can obtain other drawings based on these drawings.

Figure 1:
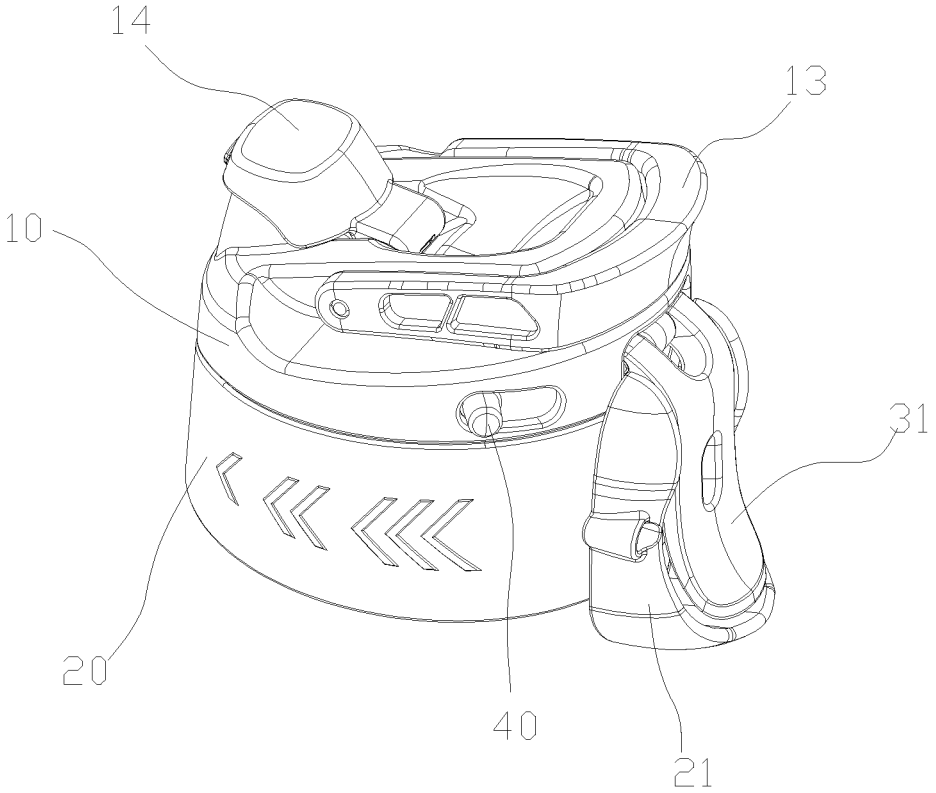
FIG. 1 is a structural view of the cup lid with pressing linkage according to an embodiment of the present disclosure.

REFERENCE SIGNS upper casing 10, through-hole 11, water outlet 12, handle frame 13, cap 14, fifth pin 141, first sealing ring 15, lower casing 20, protection frame 21, third sealing ring 22, partitioning plate 23, first limiting hole 231, water inlet 24, limiting plate 25, abutting part 251, curved groove 26, positioning groove 261, fixing recess 27, linkage assembly 30, pressing handle 31, first pin 311, first linkage 32, second pin 321, stop block 322, limiting slot 323, second linkage 33, limiting shaft 331, second sealing ring 332, third linkage 34, fourth pin 341, first supporting rod 342, second supporting rod 343, third pin 344, sealing plug 35, pressing hole 351, fixing hole 352, connecting post 353, second reset spring 36, first reset spring 37, silicone sheet 38, fixing post 381, locking pin 40, adjusting part 41, knob 411, resisting part 42, curved protrusion 43, cup body 50.

DETAILED DESCRIPTION OF THE EMBODIMENTS

In order to make the above objectives, features, and advantages of the present disclosure more obvious and understandable, the present disclosure will be further described in detail below in conjunction with the accompanying drawings and detailed embodiments.

It should be understood that, in the description of this disclosure, the orientation or positional relationship indicated by the terms "middle", "top", "bottom", "inner", "outer", etc. is based on the orientation or positional relationship shown in the drawings, and is merely for descriptive and simplifying purpose to the disclosure, and does not indicate or imply that the device or element referred to must have a specific orientation, nor be constructed and operated in a specific orientation. Therefore, it cannot be understood as a limitation on the present disclosure In addition, the terms "first" and "second" are used for descriptive purposes only, and cannot be understood as indicating or implying relative importance or implicitly indicating the number of technical features referred to. Therefore, the features defined as "first" and "second" may explicitly or implicitly include one or more of the features. In the description of the present disclosure, the meaning of "plurality" is two or more, unless otherwise specified.

In the present disclosure, unless otherwise clearly specified and limited, the terms "installation", "connected", "fixed" and other terms should be interpreted as broad meaning, for example, it may be connected or detachably connected, or formed into one entity; it may be a physical connection or electrical connection; it may be directly connected, or it may be indirectly connected through an intermediate medium; it may be an internal communication or interaction between two elements. Those skilled in the art can understand the specific meanings of the above terms in the present disclosure according to specific situations.

In the present disclosure, unless otherwise clearly specified and defined, the first feature "above" or "below" the second feature may include the direct contact of the first and second feature, or may include the first and second features not in direct contact but through another feature therebetween. Moreover, the first feature is "on", "above" and "over" the second feature includes that the first feature is directly above and obliquely above the second feature, or simply means that the first feature is higher in level than the second feature. The first feature is "under", "below" and "underneath" the second feature includes that the first feature is directly below and obliquely below the second feature, or simply means that the first feature is lower in level than the second feature.

Figure 2:
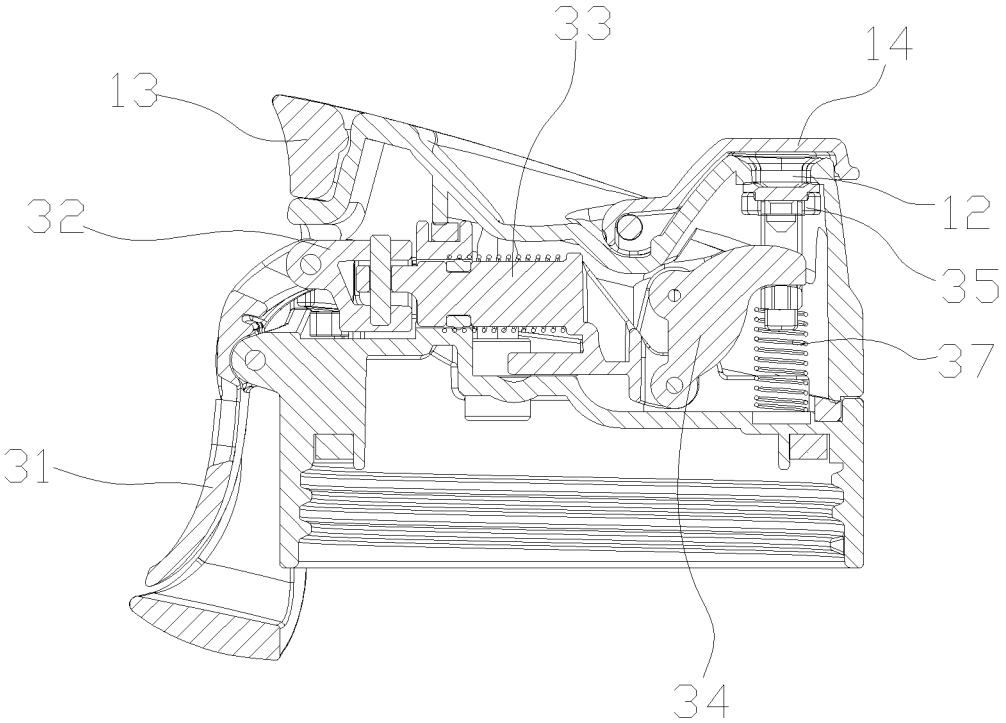
FIG. 2 is a cross-sectional view of the cup lid with pressing linkage according to an embodiment of the present disclosure.
Figure 3:
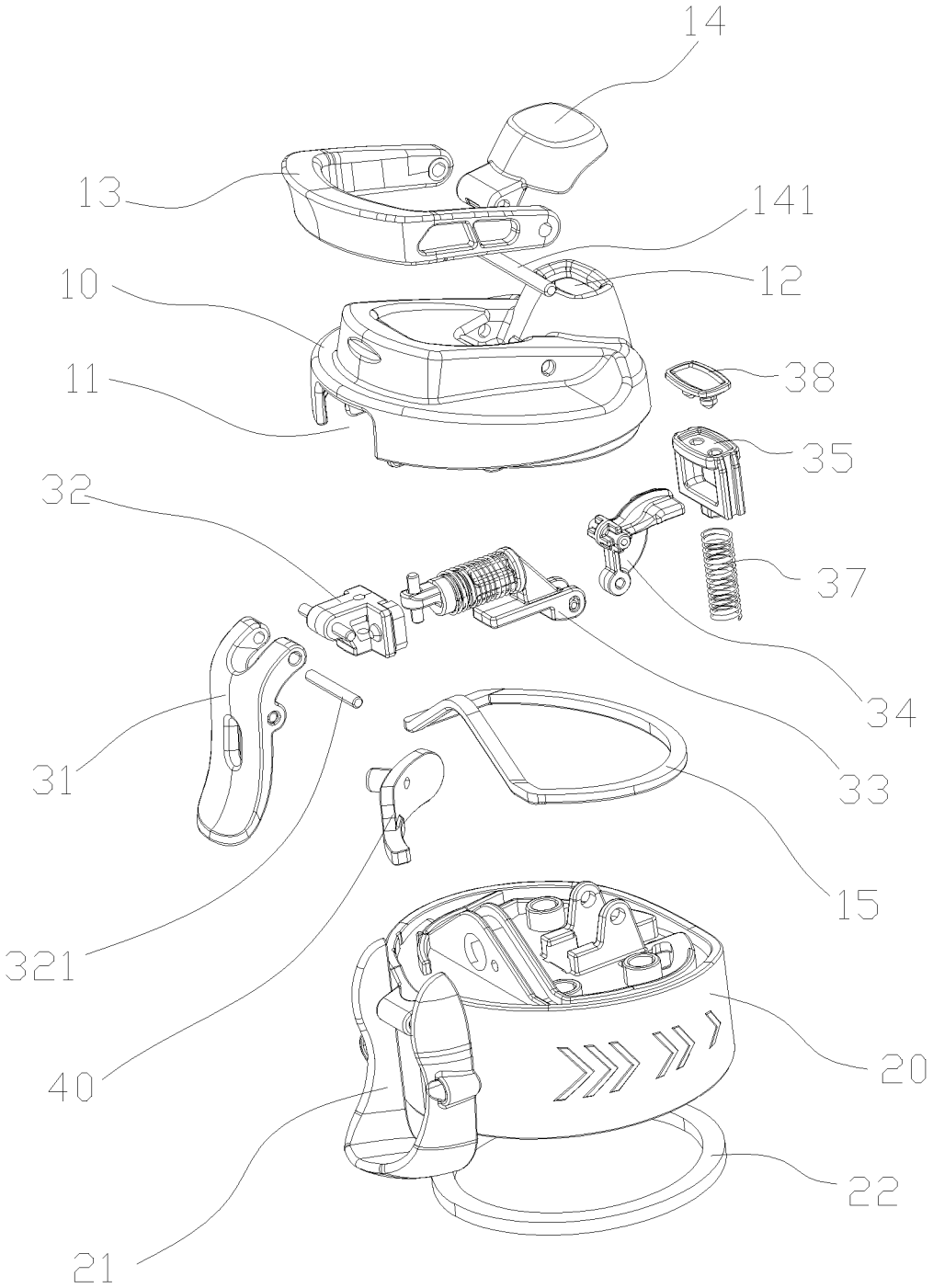
FIG. 3 is an exploded view of the cup lid with pressing linkage according to an embodiment of the present disclosure.

Referring to FIGS. 1-11, a cup lid with pressing linkage is provided in the present disclosure, in order to solve problems in the existing cup lids which have unreasonable structure that is unable to be operated with one hand, and the water outlet of which is easily contaminated. As shown in FIGS. 1 to 3, the cup lid may be applied on bottles or heat insulated cups, and the cup lid includes a hollow cover body with a water outlet 12 located on one side of a top surface of the cover body. A linkage assembly 30 is arranged in the cover body, and the linkage assembly 30 includes a first linkage 32, a second linkage 33, and a third linkage 34 connected in sequence. A though-hole 11 is provided on a side wall of the cover body, and a pressing handle 31 is hinged to an outer wall of the cover body and is rotatable relative to the cover body around the hinge. Specifically, a protrusion is integrally formed on the side wall of the cover body, and the pressing handle 31 is hinged to the protrusion at a middle point of the pressing handle 31 through a first pin 311. One end of the pressing handle 31 passes through the through-hole 11 and is connected to one end of the linkage assembly 30, and the other end of the pressing handle 31 can be pressed by fingers. In this embodiment, the pressing handle 31 has a curved plate-like structure, with a curve fitting the finger to improve the comfort when pressing. The other end of the linkage assembly 30 is connected with a sealing plug 35, and the sealing plug 35 is located at a lower end of the water outlet 12 to open and seal the water outlet 12.

Specifically, the cover body includes an upper casing 10 and a lower casing 20 that are in sealing connection while are detachable from each other. A first sealing ring 15 made of silicone material is disposed between the upper casing 10 and the lower casing 20, and the first sealing ring 15 may improve the sealing performance between the upper casing 10 and the lower casing 20. The upper casing 10 and the lower casing 20 may be detachably connected in, for example, screw connection, and the upper casing 10 and the lower casing 20 can also be integrally connected. The upper casing 10 and the lower casing 20 are detachably connected and form a hollow cavity, and the linkage assembly 30 is limited inside the cavity. A partitioning plate 23 is provided in the cavity, which separates the cover body into a first cavity and a second cavity. The water outlet 12 communicates with the second cavity, and the through-hole 11 communicates with the first cavity.

Specifically, as shown in FIGS. 7 to 10, one end of the pressing handle 31 passes through the through-hole 11 and is hinged to one end of the first linkage 32 via the second pin 321, thereby driving the first linkage 32 to move. Since the movement of the one end of the pressing handle 31 is in an arc shape, and the one end of the pressing handle 31 is connected to the one end of the first linkage 32, thus the first linkage 32 is driven to move in an arc shape by the pressing handle 31. The other end of the first linkage 32 is hinged with one end of the second linkage 33. In this embodiment, a first limiting hole 231 is provided on the partitioning plate 23, the one end of the second linkage 33 passes through the first limiting hole 231 and is connected to the other end of the first linkage 32 away from the pressing handle 31, and the other end of the second linkage 33 is hinged with one end of the third linkage 34. The first limiting hole 231 is used for restricting the second linkage 33 so that the second linkage 33 moves linearly. In a more specific embodiment, a limiting slot 323 is provided at the end of the first linkage 32 that is close to the second linkage 33, and a limiting shaft 331 is disposed inside the limiting slot 323 along a vertical direction. The one end of the second linkage 33 is provided with a second limiting hole in clearance fit with the limiting shaft, 331 and the limiting shaft 331 converts a rotary motion of the first linkage 32 into a linear motion of the second linkage 33. Specifically, the one end of the second linkage 33 is provided with the second limiting hole along the vertical direction, and is located in the limiting slot 323. The one end of the second linkage 33 is sleeved on the limiting shaft 331 via the second limiting hole, thereby moving up and down inside the limiting slot 323 relative to the limiting shaft 331. In a more specific embodiment, a stop block 322 made of silicone material is provided on the first linkage 32 close to the second linkage 33. The stop block 322 may prevent violent collision between the one end of the first linkage 32 and the partitioning plate 23.

In this embodiment, because the first linkage 32 is driven to move in an arc-shaped movement by the pressing handle 31, therefore, the second linkage 33 has a displacement along the vertical direction when it is driven by the first linkage 32. However, the second linkage 33 is restricted to move linearly in a horizontal direction by the first limiting hole 231, so that the rotatory motion of the first linkage 32 can be converted into the linear motion of the second linkage 33 through the clearance fitting between the limiting shaft 331 and the second limiting hole. The second linkage 33 is driven to move linearly along the first limiting hole 231 by the first linkage 32, when the first linkage 32 is driven by the pressing handle 31. In this embodiment, the second linkage 33 may have a rod-like structure.

The other end of the second linkage 33 is hinge to the one end of the third linkage 34. The third linkage 34 includes a first supporting rod 342 and a second supporting rod 343 that are integrally connected with a predetermined angle therebetween. The predetermined angle may be 60° to 150°. In this embodiment, the first supporting rod 342 and the second supporting rod 343 are connected perpendicularly. The third linkage 34 is vertically placed inside the cover body, and limiting plates 25 are arranged on two sides corresponding to the third linkage 34 on an inner wall of the cover body. The limiting plates 25 are vertically and fixedly connected to an inner wall of the lower casing 20. The first supporting rod 342 and the second supporting rod 343 are hinged to the limiting plates 25 at the connection point therebetween through a third pin 344 and are rotatable around the hinged point. One end of the first supporting rod 342 and one end of the second supporting rod 343 are integrally connected, and the other end of the first supporting rod 342 is hinged with the other end of the second linkage 33 through a fourth pin 341, and the first supporting rod 342 is rotatable around the hinged point. In this embodiment, a position of the fourth pin 341 is lower than a position of the third pin 344, and the third linkage 34 is driven to rotate around the third pin 344 by the second linkage 33 through the fourth pin 341, when the second linkage 33 is driven to move linearly along the horizontal direction by the first linkage 32. The first supporting rod 342 is in a vertical state, and the second supporting rod 343 is in a horizontal state when the water outlet 12 is blocked by the sealing plug 35. A sealing plug 35 is connected with the other end of the third linkage 34, and is located directly below the water outlet 12. The sealing plug 35 has a square shape, and an upper end thereof matches with the water outlet 12. In this embodiment, the sealing plug 35 is provided with a pressing hole 351 matching with an end of the second supporting rod 343, and the end of the second supporting rod 343 is disposed inside the pressing hole 351. The end of the second supporting rod 343 moves downward when the third linkage 34 is driven to rotate around the third pin 344 by the second linkage 33, thereby pressing the sealing plug 35 to move downward, and opening the water outlet 12. In a specific embodiment, an abutting part 251 is further provided on one side of the limiting plates 25, for further limiting the second linkage 33 to move in a horizontal direction on the upper surface of the lower casing.

Specifically, in order to avoid the misalignment of the sealing plug 35 from the water outlet 12 when moving up and down, two sides of the sealing plug 35 are provided with sliding grooves along the vertical direction, and the inner wall of the cover body is provided with sliding rails which can cooperate with the sliding grooves on both sides corresponding to the sealing plug 35. The sealing plug 35 is driven to move up and down along the sliding rails by the third linkage 34. In this embodiment, the sliding rails are reinforcing ribs integrally formed on the inner wall of the upper casing 10, and two sides of the sliding grooves cooperate with edges of the reinforcing ribs to move up and down along the edges of the reinforcing ribs, so that the sealing plug 35 can move in liner movement, and accurately align with the water outlet 12.

Figure 4:
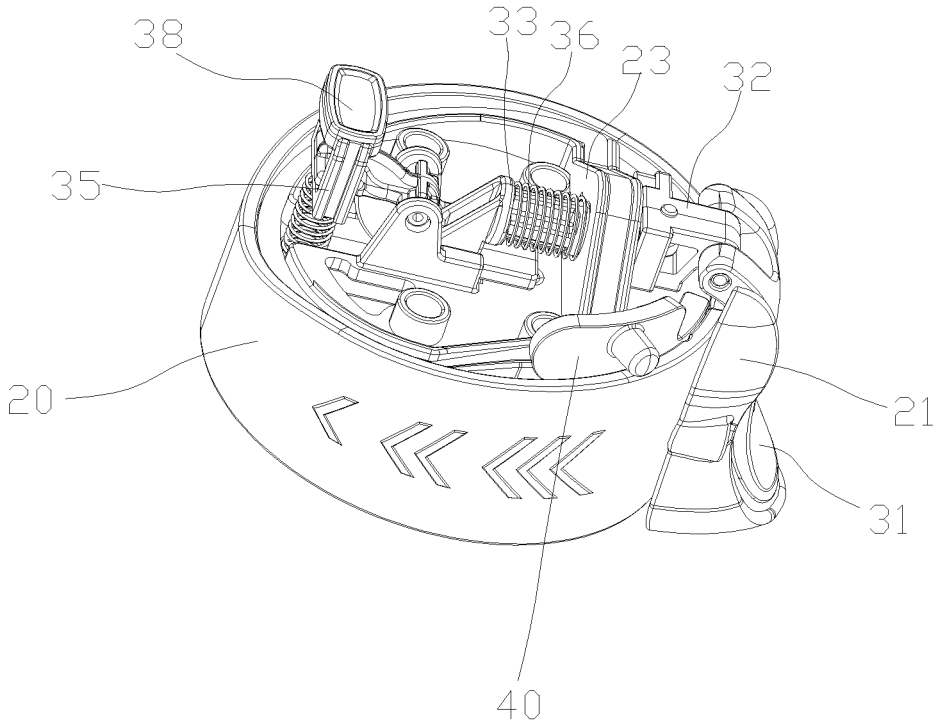
FIG. 4 is a structural view of the internal structure of the cup lid with pressing linkage according to an embodiment of the present disclosure.
Figure 5:
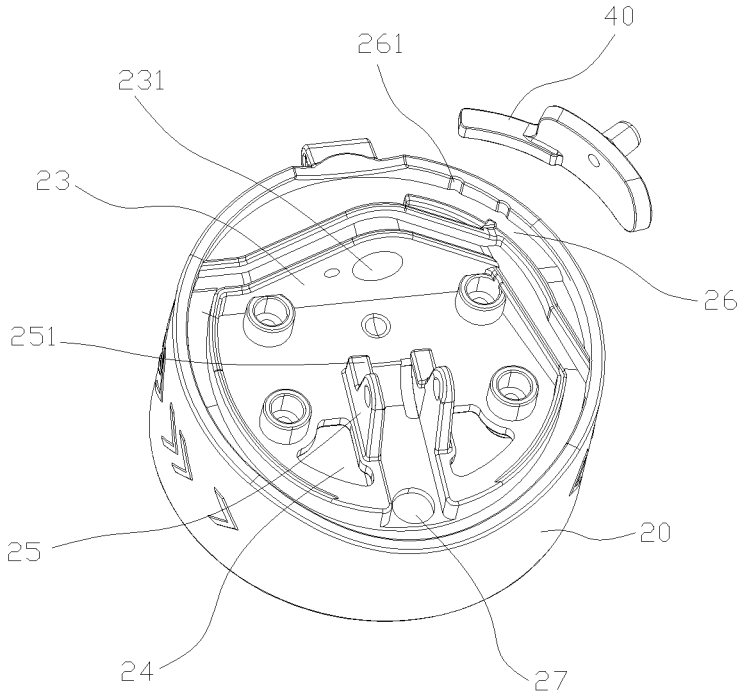
FIG. 5 is another exploded view of the cup lid with pressing linkage according to an embodiment of the present disclosure.
Figure 8:
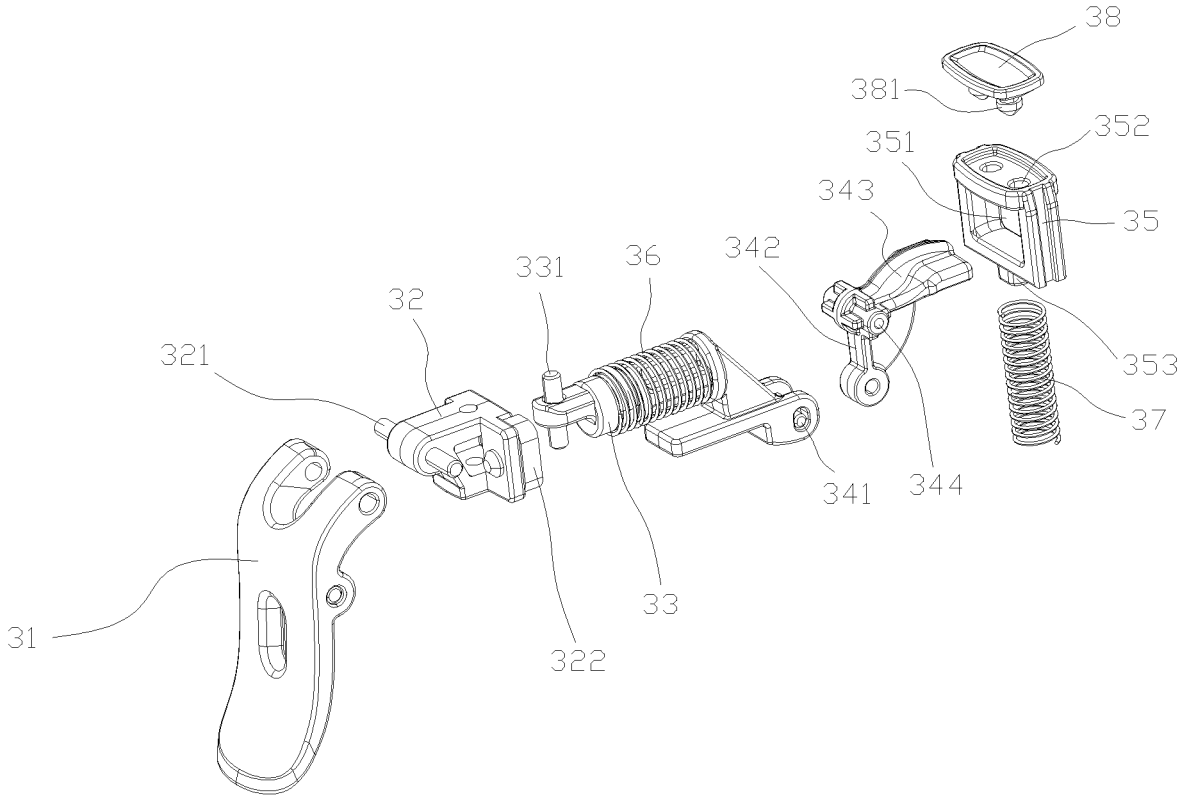
FIG. 8 is an exploded view of the linkage assembly of the cup lid with pressing linkage according to an embodiment of the present disclosure.

Specifically, a first reset spring 37 is arranged between a lower end of the sealing plug 35 and the inner wall of the cover body, for controlling the sealing plug 35 to move upward. In this embodiment, as shown in FIGS. 4, 5, and 8, a connecting post 353 is integrally formed on the lower end of the sealing plug 35, and a fixing recess 27 is formed on the inner wall of the lower casing 20, such that one end of the first reset spring 37 is sleeved on the connecting post 353, and the other end of the first reset spring 37 is limited within the fixing recess 27. Furthermore, the first reset spring 37 is a compression spring, and the sealing plug 35 is closed as in an initial state. The first reset spring 37 is in a compressed state as the linkage assembly 30 forces the sealing plug 35 to move downward, when the pressing handle 31 is pressed. The first reset spring 37 restores, and forces the sealing plug 35 to move upward to seal the water outlet 12, and at the same time controls the linkage assembly 30 and the pressing handle 31 to return to original positions when the pressing handle 31 is released.

Figure 9:
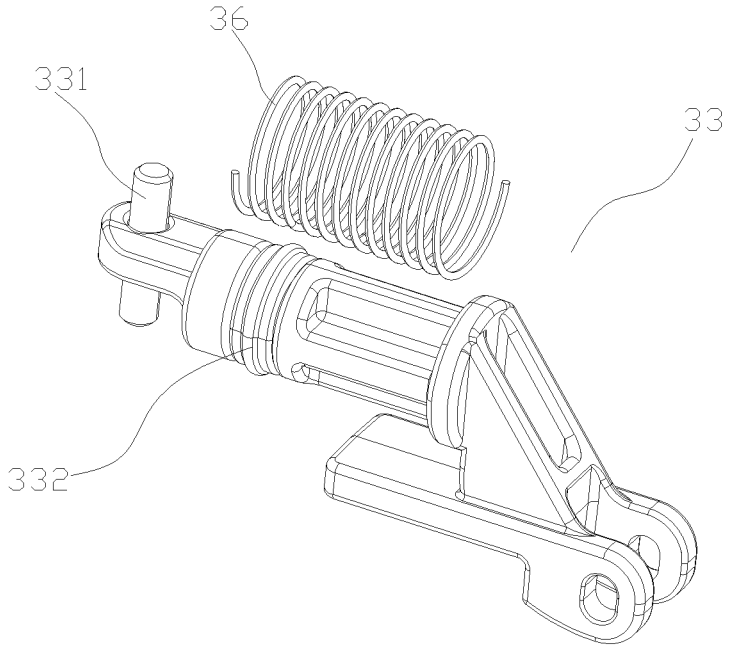
FIG. 9 is a structural view of the second linkage of the cup lid with pressing linkage according to an embodiment of the present disclosure.
Figure 10:
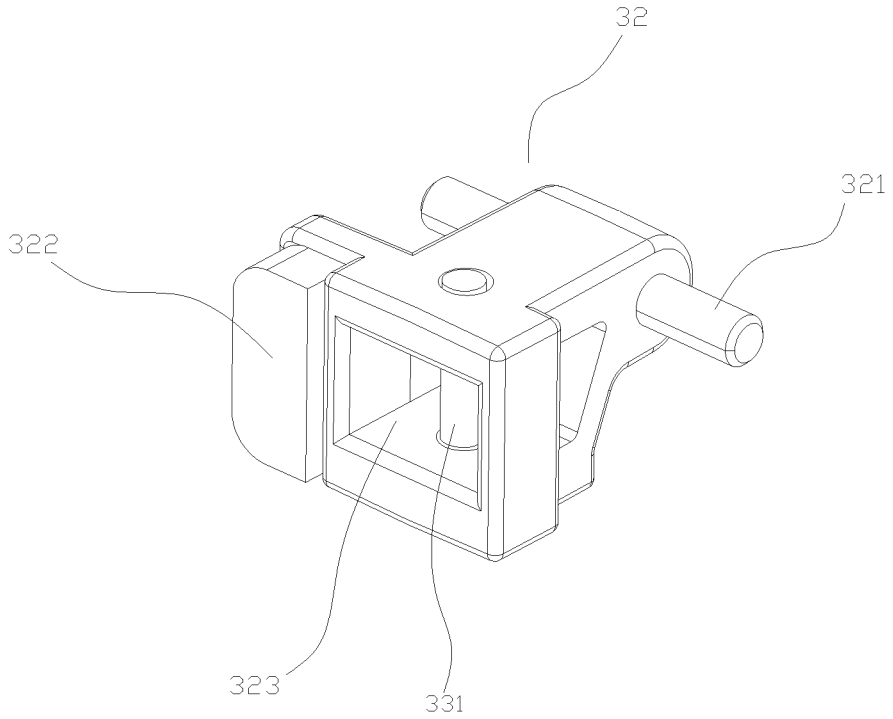
FIG. 10 is a structural view of the first linkage of the cup lid with pressing linkage according to an embodiment of the present disclosure.
Figure 11:
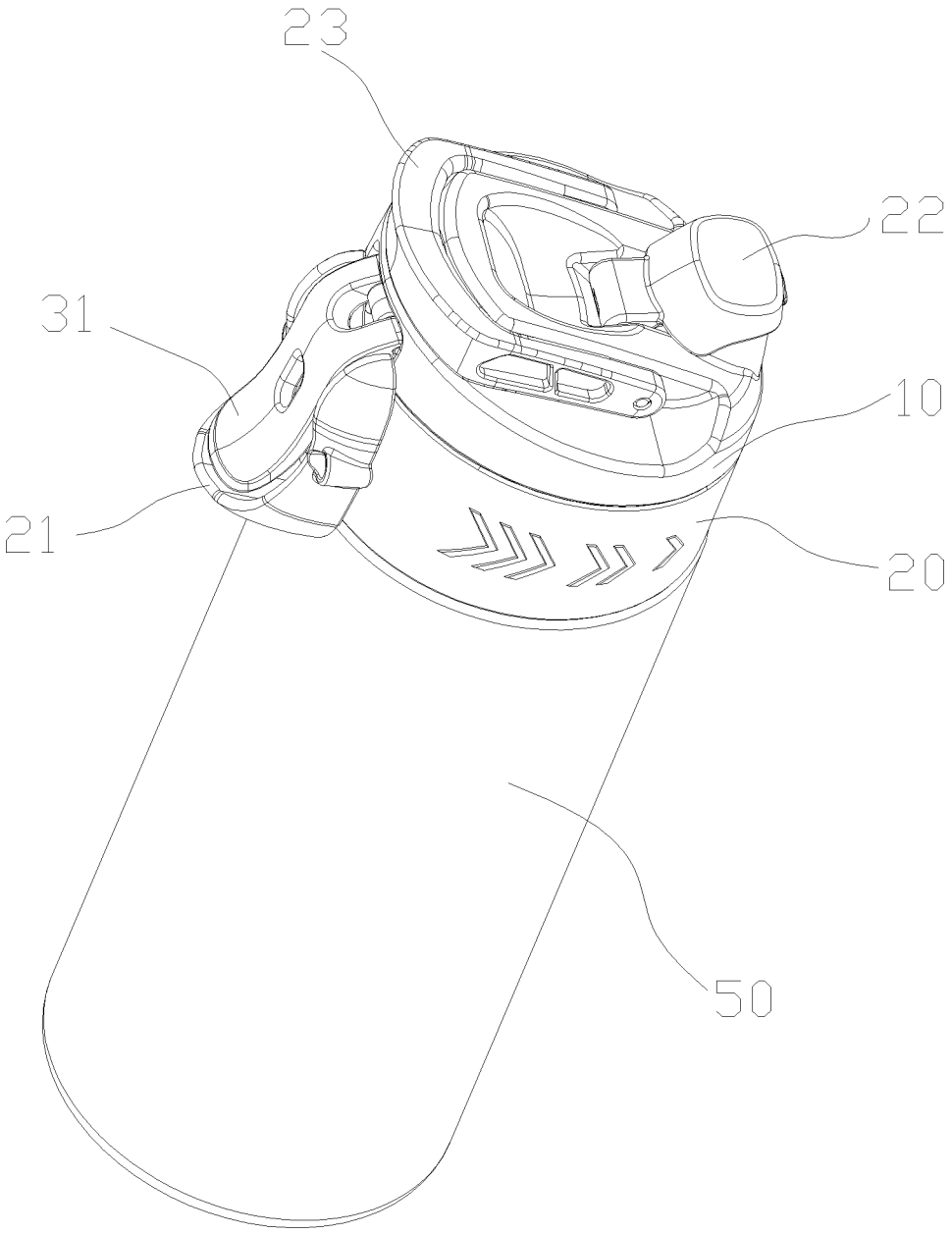
FIG. 11 is a structural view of the cup according to an embodiment of the present disclosure.

In a specific embodiment, in order to further control the resetting of the linkage assembly 30 and the pressing handle 31, a second reset spring 36 is disposed between the end of the second linkage 33 away from the first linkage 32 and the partitioning plate 23. The second reset spring 36 is a compression spring. As shown in FIGS. 2 and 9, the second reset spring 36 is sleeved on the second linkage 33, with one end thereof abutting on one side of the partitioning plate 23, and the other end thereof abutting on the second linkage 33. When the pressing handle 31 is pressed, the first linkage 32 and the second linkage 33 is driven to move leftward by the pressing handle 31, and the third linkage 34 is rotated by the second linkage 33, so that the sealing plug 35 is pressed downward by one end of the second supporting rod 343 to open the water outlet 12. Meanwhile, the first reset spring 37 and the second reset spring 36 are in the compressed state. When the pressing handle 31 is released, the first reset spring 37 and the second reset spring 36 are restored, and the linkage assembly 30, the pressing handle 31, and the sealing plug 35 are reset, thereby sealing the water outlet 12. The first reset spring 37 and the second reset spring 36 ensure a tight abutment at the sealing plug 35, so that further improve the leak-proof performance.

In this embodiment, in order to further improve the sealing performance of the sealing plug 35, a silicone sheet 38 matching with the water outlet 12 is disposed on the upper end of the sealing plug 35. A fixing post 381 is provided on a bottom surface of the silicone sheet 38, and a fixing hole 352 matching with the fixing post 381 is provided on the upper end of the sealing plug 35. The fixing post 381 is inserted into the fixing hole 352, so that the silicone sheet 38 is detachable connected with the sealing plug 35. The water outlet 12 is sealed by the silicone sheet 38, which may improve the leak-proof performance.

Specifically, the water outlet 12 is in communication with the second cavity, and a water inlet 24 in communication with the second cavity is provided the lower casing 20. In order to further improve the sealing performance of the sealing plug 35, the first cavity and the second cavity are sealed relative to each other, and a second sealing ring 332 is disposed between the second linkage 33 and the first limiting hole 231. The second sealing ring 332 is a silicone ring. Since the first cavity and the second cavity are only communicated through the first limiting hole 231, the second sealing ring 332 may further improve the sealing performance of the second cavity.

Figure 6:
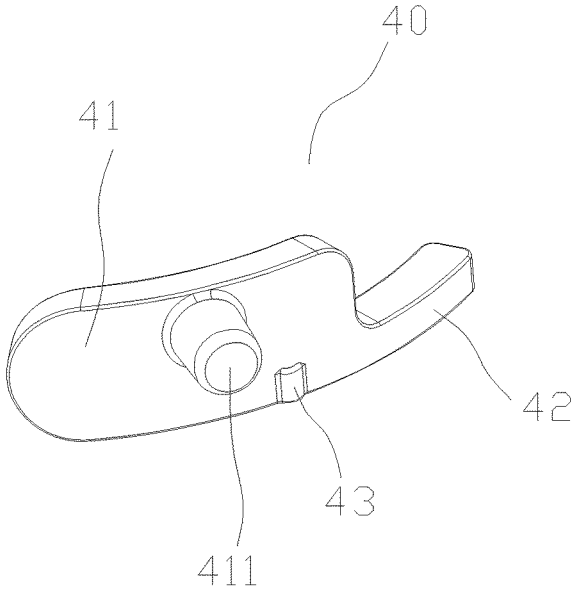
FIG. 6 is a structural view of the locking pin of the cup lid with pressing linkage according to an embodiment of the present disclosure.
Figure 7:
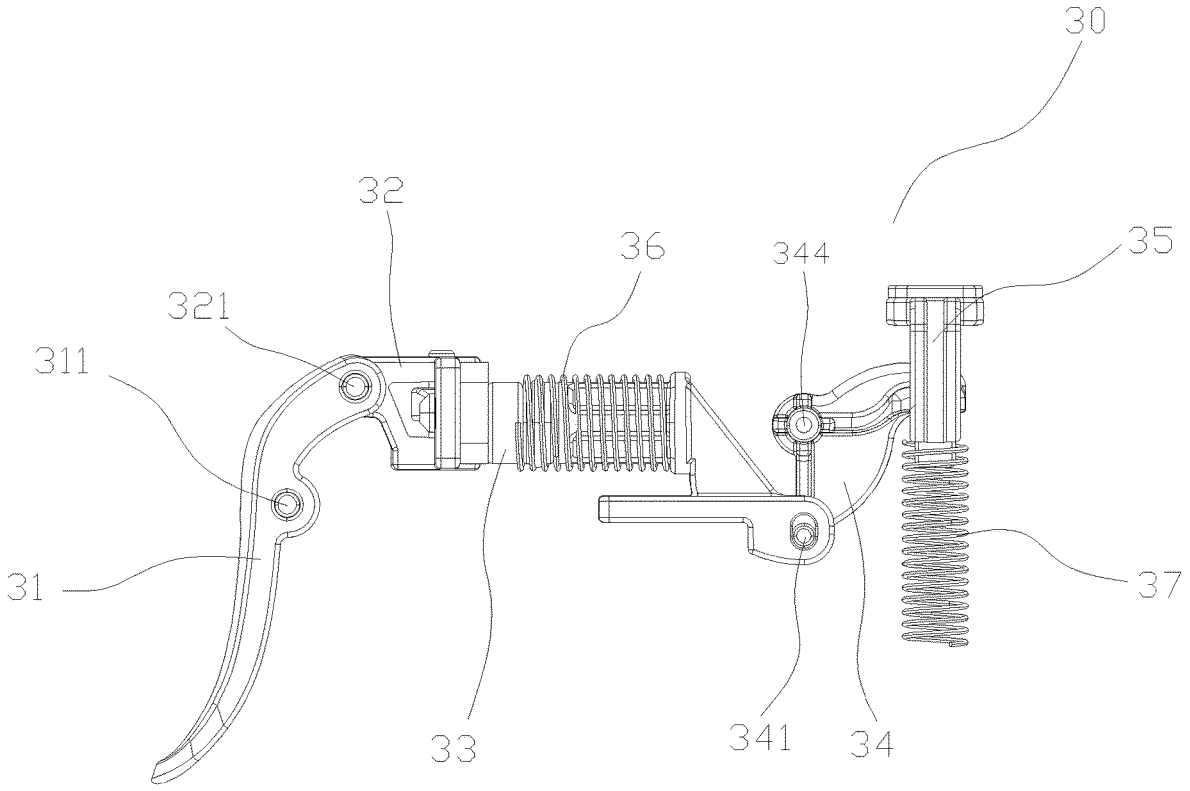
FIG. 7 is a structural view of the linkage assembly of the cup lid with pressing linkage according to an embodiment of the present disclosure.

Specifically, a locking pin 40 for blocking one side of the first linkage 32 is disposed in the first cavity, and the locking pin 40 is provided with a knob 411 extending out of the side wall of the cover body. In this embodiment, as shown in FIGS. 4 to 6, the locking pin 40 is located in the first cavity, and a curved groove 26 matching with the locking pin 40 is provided on an edge of the first cavity. The locking pin 40 is located in the curved groove 26 and can be placed abutted against one side of the first linkage 32, so as to prevent the first linkage 32 from moving. Furthermore, the locking pin 40 includes a resisting part 42 and an adjusting part 41 integrally connected to the resisting part 42. The outer wall of the adjusting part 41 is integrally connected with a cylindrical knob 411, and the outer wall of the upper casing 10 is provided with an adjusting hole, and the knob 411 extends out of the cover body through the adjusting hole. The resisting part 42 is adjusted to abut against one side of the first linkage 32 by operating the knob 411. In a specific embodiment, as shown in FIG. 5, positioning grooves 261 are provided on an inner wall of the curved groove 26, and a curved protrusion 43 matching the positioning grooves 261 is provided on the outer wall of the adjusting part 41. The number of positioning grooves 261 in this embodiment is two. The resisting part 42 is abutted against the one side of the first linkage 32 when the knob 411 is toggled such that the curved protrusion 43 is fitted into one of the positioning grooves 261, and the resisting part 42 moves away from the one side of the first linkage 32 when the knob 411 is toggled so that the curved protrusion 43 is fitted into the other one of the positioning grooves 261.

Specifically, a cap 14 adapted to the water outlet 12 is hinged to the outer wall of the cover body through a fifth pin 141, and the cap 14 covers the water outlet 12 to ensure the sanitation of the water outlet 12. In a specific embodiment, a handle frame 13 is also hinged through the fifth pin 141, and the cap 14 and the handle frame 13 is rotatable around the fifth pin 141. The outer wall of the upper casing 10 is also provided with an open groove for accommodating the handle frame 13.

Specifically, a protection frame 21 is fixed on the side wall of the cover body corresponding to the periphery of the pressing handle 31, and the protection frame 21 may prevent the pressing handle 31 from being unintentionally pressed.

The cup lid with pressing linkage provided by the present disclosure has a compact structure. The pressing handle 31 is connected with the sealing plug 35 through the linkage assembly 30, so that the pressing handle 31 may be operated with one hand, and then control the sealing plug 35 to open or close the water outlet 12 through transmission via the linkage assembly 30. The linkage assembly 30 provided has a low gear ratio, for example, the sealing plug may be pressed 7 mm downward when the pressing handle is pressed 4 mm downward, which is operated easily and efficiently.

The present disclosure further provides a cup, which includes the above-mentioned cup lid with pressing linkage, and further includes a hollow cup body 50, and the cup body 50 is sealed while detachably connected with the cup lid. In this embodiment, the cup cover and the cup body 50 are in thread connection, and a third sealing ring 22, which is a silicone ring, is provided between the cup cover and the cup body 50. The outer wall of the cup lid is also provided with non-slip patterns. The cup provided has better sealing performance compared with the existing cups, and at the same time, avoids leakage or the contamination of the water outlet 12 after repeated use, which can improve the user experience.

The above are merely detailed embodiments of the present disclosure, but the protection scope of the present disclosure is not limited thereto. Other changes and substitutions obtained by those skilled in the art on the basis of the technical proposals and concepts described above, shall fall within the scope of protection of the claims of the present disclosure. Therefore, the scope of protection of the present disclosure is defined by the appended claims.

What is claimed is:

1. A cup lid with pressing linkage, comprising a hollow cover body with a water outlet, a linkage assembly including a first linkage, a second linkage, and a third linkage that are connected in sequence being arranged in the cover body;

wherein a though-hole is provided on one side of the cover body, and a pressing handle is hinged with an outer wall of the cover body and is rotatable relative to the cover body around a hinge point, and one end of the pressing handle passes through the though-hole and is hinged to one end of the first linkage;

a partitioning plate is provided in the cover body, with a first limiting hole provided thereon, one end of the second linkage passes through the first limiting hole and is connect to an end of the first linkage away from the pressing handle, the first limiting hole is used for restricting the second linkage so that the second linkage moves linearly; and the other end of the second linkage is hinged with one end of the third linkage, and the other end of the third linkage is connected with a sealing plug, the third linkage is used for controlling the sealing plug to open or seal the water outlet.

2. The cup lid with pressing linkage according to claim 1, wherein the third linkage comprises a first supporting rod and a second supporting rod that are integrally connected with a pre-determined angle therebetween, and limiting plates are arranged on two sides corresponding to the third linkage on an inner wall of the cover body, and the first supporting rod and the second supporting rod are hinged to the limiting plates at a connection point therebetween, and ends of the first supporting rod and the second supporting rod that are away from the connection point are connected with the second linkage and the sealing plug, respectively.

3. The cup lid with pressing linkage according to claim 2, wherein the pre-determined angle is 90° to 150°.

4. The cup lid with pressing linkage according to claim 2, wherein the sealing plug is located below the water outlet, a pressing hole matching with an end portion of the second supporting rod is provided on the sealing plug, and one end of the second supporting rod is disposed inside the pressing hole for pressing the sealing plug downward.

5. The cup lid with pressing linkage according to claim 4, wherein a first reset spring is disposed between a lower end of the sealing plug and the inner wall of the cover body, and the first reset spring is used for controlling the sealing plug to move upward.

6. The cup lid with pressing linkage according to claim 4, wherein a second reset spring is disposed between the other end of the second linkage that is away from the first linkage and the partitioning plate.

7. The cup lid with pressing linkage according to claim 1, wherein sliding grooves are provided along a vertical direction on two sides of the sealing plug, and sliding rails matching with the sliding grooves are provided on two sides of the inner wall of the cover body corresponding to the sealing plug, so that the sealing plug can move linearly along the sliding rails.

8. The cup lid with pressing linkage according to claim 1, wherein a limiting slot is provided at the one end of the first linkage that is close to the second linkage, and a limiting shaft is disposed inside the limiting slot along a vertical direction, wherein the one end of the second linkage is provided with a second limiting hole in clearance fit with the limiting shaft, and the limiting shaft converts a rotary motion of the first linkage into a linear motion of the second linkage.

9. The cup lid with pressing linkage according to claim 1, wherein the partitioning plate separates the cover body into a first cavity and a second cavity, the water outlet is in communication with the second cavity, the second linkage is fitted to and sealed with the first limiting hole, and a bottom wall of the cover body is provided with a water inlet in communication with the second cavity.

10. The cup lid with pressing linkage according to claim 9, wherein a locking pin for blocking one side of the first linkage is arranged inside the first cavity, and the locking pin is provided with a knob extending out of a side wall of the cover body.

* * * * *